US010127861B2

(12) United States Patent
Na et al.

(10) Patent No.: US 10,127,861 B2
(45) Date of Patent: Nov. 13, 2018

(54) SCAN DRIVER AND DISPLAY DEVICE HAVING THE SAME

(71) Applicant: Samsung Display Co., Ltd., Yongin-si, Gyeonggi-Do (KR)

(72) Inventors: Ji-Su Na, Yongin-si (KR); Jin-Tae Jeong, Suwon-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/392,966

(22) Filed: Dec. 28, 2016

(65) Prior Publication Data

US 2017/0186378 A1 Jun. 29, 2017

(30) Foreign Application Priority Data

Dec. 29, 2015 (KR) ..... 10-2015-0188304

(51) Int. Cl.

| | |
|---|---|
| ***G09G 5/00*** | (2006.01) |
| ***G09G 3/3266*** | (2016.01) |
| ***G09G 3/3233*** | (2016.01) |
| *G09G 3/3275* | (2016.01) |

(52) U.S. Cl.

CPC ..... *G09G 3/3266* (2013.01); *G09G 3/3233* (2013.01); *G09G 3/3275* (2013.01); *G09G 2310/0205* (2013.01); *G09G 2310/0286* (2013.01); *G09G 2310/0289* (2013.01); *G09G 2310/0291* (2013.01); *G09G 2310/08* (2013.01); *G09G 2320/02* (2013.01)

(58) Field of Classification Search

CPC ..... G09G 3/3266; G09G 3/3275; G09G 5/00; G09G 2310/0205; G09G 2310/027; G09G 2310/0286; G09G 2310/0294

See application file for complete search history.

(56) References Cited

U.S. PATENT DOCUMENTS

| | | | | |
|---|---|---|---|---|
| 5,657,041 | A * | 8/1997 | Choi | G09G 3/3622 345/94 |
| 2004/0001054 | A1* | 1/2004 | Nitta | G09G 3/3648 345/204 |
| 2004/0169631 | A1* | 9/2004 | Tanaka | G09G 5/006 345/96 |
| 2008/0079685 | A1* | 4/2008 | Umezaki | G09G 3/3677 345/100 |

(Continued)

FOREIGN PATENT DOCUMENTS

KR 10-2016-0101824 A 8/2016

*Primary Examiner* — Joe H Cheng

(74) *Attorney, Agent, or Firm* — Innovation Counsel LLP

(57) ABSTRACT

A scan driver includes a plurality of scan driving blocks. Each of the scan driving blocks includes a first shift register including a plurality of driving transistors, the first shift register being configured to provide a first driving signal to a first driving node and to provide a second driving signal to a second driving node, a second shift register including a plurality of masking transistors, the second shift register being configured to provide a masking signal to a masking output node, and a buffer circuit including a plurality of buffer transistors, the buffer circuit being configured to provide scan signals. The buffer circuit outputs the scan signals that include the first pulse or the scan signals that include the first pulse and the second pulse based on the masking signal.

19 Claims, 18 Drawing Sheets

(56) References Cited

U.S. PATENT DOCUMENTS

2010/0295837 A1* 11/2010 Yoshinaga ..... G09G 3/003
345/211
2012/0113090 A1* 5/2012 Minami ..... G09G 3/3648
345/213
2012/0169678 A1* 7/2012 Shin ..... G09G 3/20
345/204
2013/0009938 A1* 1/2013 Hwang ..... G09G 3/348
345/212
2013/0314385 A1* 11/2013 Kim ..... G09G 3/3225
345/204
2014/0362317 A1* 12/2014 Kubota ..... G02F 1/133707
349/39
2016/0063961 A1* 3/2016 Pyo ..... G09G 3/2022
345/213
2016/0163401 A1* 6/2016 Nonaka ..... G11C 19/28
345/214
2016/0210900 A1* 7/2016 Kim ..... G09G 3/3233

* cited by examiner

SCAN DRIVER AND DISPLAY DEVICE HAVING THE SAME

CROSS-REFERENCE TO RELATED APPLICATION(S)

This application claims priority under 35 USC § 119 to Korean Patent Application No. 10-2015-0188304, filed on Dec. 29, 2015 in the Korean Intellectual Property Office (KIPO), the contents of which are incorporated herein in its entirety by reference.

BACKGROUND

1. Technical Field

The present disclosure relates generally to a scan driver and a display device having the same, more particularly, to a pixel and a display device having the same.

2. Description of the Related Art

Flat panel display (FPD) devices are widely used as a display device of various electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. The OLED devices have been spotlighted as a next-generation display device for their various advantages such as a wide viewing angle, a rapid response speed, a thin thickness, and low power consumption.

A typical flat panel display device includes a display panel that includes pixels electrically coupled between scan lines and data lines, a scan driver that provides a scan signal to the scan lines, and a data driver that provides a data signal to the data lines. Each of the pixels emits light in response to the data signal and the scan signal. Recently, a blockwise driving method that provides scan signals to a plurality of scan lines from one scan driving block has been studied and developed.

SUMMARY

Some example embodiments provide a scan driver capable of improving a display quality when a blockwise driving method is used.

Some example embodiments provide a display device capable of improving a display quality when a blockwise driving method is used.

According to an aspect of example embodiments, a scan driver may include a plurality of scan driving blocks. Each of the scan driving blocks may includes a first shift register including a plurality of driving transistors, the first shift register being configured to provide a first driving signal to a first driving node and to provide a second driving signal to a second driving node by turning on or turning off the plurality of driving transistors based on a first scan start signal or a previous scan output signal, and a plurality of driving clock signals, a second shift register including a plurality of masking transistors, the second shift register being configured to provide a masking signal to a masking output node by turning on or tuning off the plurality of masking transistors based on a second scan start signal or a previous masking output signal, and a plurality of masking clock signals, and a buffer circuit including a plurality of buffer transistors, the buffer circuit being configured to provide scan signals by turning on or tuning off the plurality of buffer transistors based on a plurality of scan clock signals that include a first pulse and a second pulse, the first driving signal, the second driving signal, and the masking signal. The buffer circuit may output the scan signals that include the first pulse or the scan signals that include the first pulse and the second pulse based on the masking signal.

In example embodiments, the buffer transistors may be p-channel metal-oxide semiconductor (PMOS) transistors.

In example embodiments, the buffer circuit may output the scan signals that include the first pulse when the masking signal has a low level.

In example embodiments, the buffer circuit may output the scan signals that include the first pulse and the second pulse when the masking signal has a high level.

In example embodiments, the buffer transistors may be n-channel metal-oxide semiconductor (NMOS) transistors.

In example embodiments, the buffer circuit may output the scan signals that include the first pulse when the masking signal has a high level.

In example embodiments, the buffer circuit may output the scan signals that include the first pulse and the second pulse when the masking signal has a low level.

According to an aspect of example embodiments, a display device may include a display panel including a plurality of pixel circuits, a data driver configured to provide a data signal to the display panel through a plurality of data lines, a scan driver including a plurality of scan driving blocks that provide a scan signal to the display panel through a plurality of scan lines, and a timing controller configured to control the data driver and the scan driver. Each of the scan driving blocks may output the scan signal that includes a first pulse or the scan signal that includes the first pulse and a second pulse.

In example embodiments, each of the scan driving blocks may include a first shift register including a plurality of driving transistors, the first shift register being configured to provide a first driving signal to a first driving node and to provide a second driving signal to a second driving node by turning on or turning off the plurality of driving transistors based on a first scan start signal or a previous scan output signal, and a plurality of driving clock signals, a second shift register including a plurality of masking transistors, the second shift register being configured to provide a masking signal to a masking output node by turning on or turning off the plurality of masking transistors based on a second scan start signal or a previous masking output signal, and a plurality of masking clock signals, and a buffer circuit including a plurality of buffer transistors, the buffer circuit being configured to provide the scan signals by turning on or turning off the plurality of buffer transistors based on a plurality of scan clock signals that includes a first pulse and a second pulse, the first driving signal, the second driving signal, and the masking signal.

In example embodiments, the buffer circuit may output the scan signals that include the first pulse or the scan signals that include the first pulse and the second pulse based on the masking signal.

In example embodiments, the buffer transistors may be p-channel metal-oxide semiconductor (PMOS) transistors.

In example embodiments, the buffer circuit may output the scan signals that include the first pulse when the masking signal has a low level.

In example embodiments, the buffer circuit may output the scan signals that include the first pulse and the second pulse when the masking signal has a high level.

In example embodiments, the buffer transistors may be n-channel metal-oxide semiconductor (NMOS) transistors.

In example embodiments, the buffer circuit may output the scan signals that include the first pulse when the masking signal has a high level.

In example embodiments, the buffer circuit may output the scan signals that include the first pulse and the second pulse when the masking signal has a low level.

In example embodiments, the timing controller may receive an input data of the plurality of pixel circuits and divide a frame into a plurality of periods.

In example embodiments, the scan driver may output the scan signal that includes the first pulse in a partial period among the plurality of periods.

In example embodiments, the scan driver may output the scan signal that includes the first pulse and the second pulse in a partial period among the plurality of periods.

In example embodiments, each of the scan driving blocks may provide the scan signal to at least one scan line.

Therefore, a scan driver and a display device including the scan driver may avoid defects that can occur on a display panel by providing scan signals having one pulse or two pulses based on a driving period of the pixel circuits. Thus, a display quality of the display device may be improved.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Hereinafter, various example embodiments of the present disclosure will be explained in detail with reference to the accompanying drawings.

Figure 1:
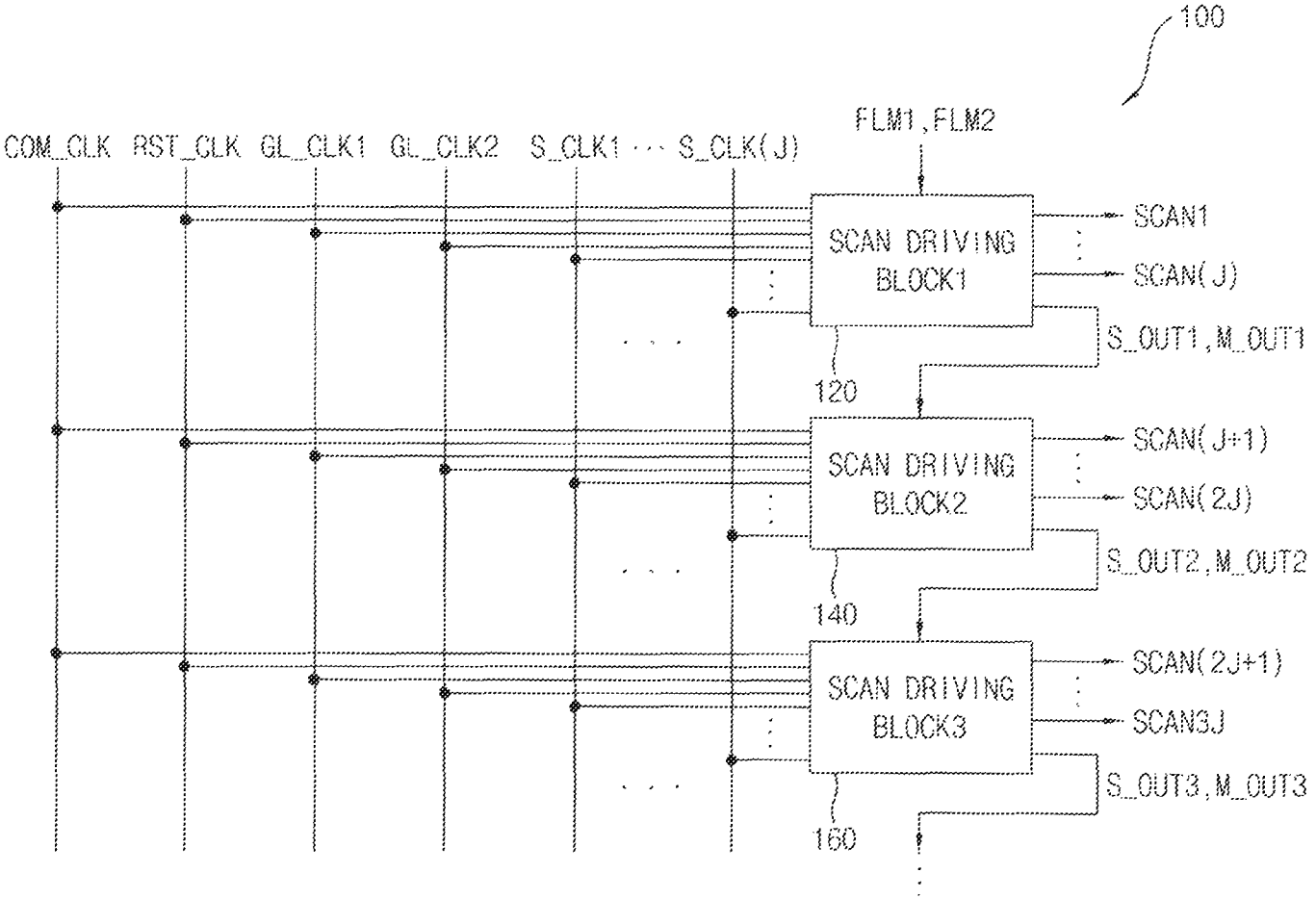
FIG. 1 is a block diagram illustrating a scan driver, according to example embodiments.

FIG. 1 is a block diagram illustrating a scan driver, according to example embodiments.

Referring to FIG. 1, a scan driver 10 may include a plurality of scan driving blocks 120, 140, and 160.

The scan driver 100 may provide scan signals to a display panel of a display device through scan lines. Each of the scan driving blocks 120, 140, and 160 may provide the scan signals to at least one scan line. For example, one scan driving block may generate and provide scan signals SCAN1 through SCAN8 provided to eight scan lines.

Referring to FIG. 1, a first scan driving block 120 may generate first through Jth scan signals SCAN1 through SCAN(J) based on a first scan start signal FLM1 and a second scan start signal FLM2, and a first driving clock signal COM_CLK, a second driving clock signal RST_CLK, a first masking clock signal GL_CLK1, a second masking clock signal GL_CLK2, and a plurality of scan clock signals S_CLK1 through S_CLK(J) provided through a plurality of clock signal providing lines, where the J is an integer equal to or greater than 1. The first scan driving block 120 may be coupled to the first through Jth scan lines. The first scan driving block 120 may provide the first through Jth scan signals SCAN1 through SCAN(J) to the pixels of the display panel through each of the scan lines. The first scan driving block 120 may generate the first through Jth scan signals SCAN1 through SCAN(J) based on an operation of pixels in the display panel. In some example embodiments, the first scan driving block 120 may generate the first through Jth scan signals SCAN1 through SCAN(J) having a first pulse. In other example embodiments, the first scan driving block 120 may generate the first through Jth scan signals SCAN1 through SCAN(J) having a first pulse and a second pulse. Further, the first scan driving block 120 may provide a scan output signal S_OUT1 and a masking output signal M_OUT1 to a second scan driving block 140.

The second scan driving block 140 may generate (J+1)th through (2J)th scan signals SCAN(J+1) through SCAN(2J) based on the scan output signal S_OUT1 and masking output signal M_OUT1 received from the first scan driving block 120, and the first driving clock signal COM_CLK, the second driving clock signal RST_CLK, the first masking clock signal GL_CLK1, the second masking clock signal GL_CLK2, and the plurality of scan clock signals S_CLK1 through S_CLK(J) provided through the plurality of clock signal providing lines. The second scan driving block 140 may be coupled to the (J+1)th through (2J)th scan lines. The second scan driving block 140 may provide the (J+1)th through (2J)th scan signals SCAN(J+1) through SCAN(2J) to the pixels of the display panel through each of the scan lines. The second scan driving block 140 may generate the (J+1)th through (2J)th scan signals SCAN(J+1) through SCAN(2J) based on the operation of pixels in the display panel. In some example embodiments, the second scan driving block 140 may generate the (J+1)th through (2J)th scan signals SCAN(J+1) through SCAN(2J) having the first pulse. In other example embodiments, the second scan driving block 140 may generate the (J+1)th through (2J)th scan signals SCAN(J+1) through SCAN(2J) having the first pulse and the second pulse. Further, the second scan driving block 140 may provide a scan output signal S_OUT2 and a masking output signal M_OUT2 to a third scan driving block 160.

The third scan driving block 160 may generate (2J+1)th through (3J)th scan signals SCAN(2J+1) through SCAN(3J) based on the scan output signal S_OUT2 and masking output signal M_OUT2 received from the second scan driving block 140, and the first driving clock signal COM_

CLK, the second driving clock signal RST_CLK, the first masking clock signal GL_CLK1, the second masking clock signal GL_CLK2, and the plurality of scan clock signals S_CLK1 through S_CLKJ provided through the plurality of clock signal providing lines. The third scan driving block 160 may be coupled to the (2J+1)th through (3J)th scan lines. The third scan driving block 160 may provide the (2J+1)th through (3J)th scan signals SCAN(2J+1) through SCAN(3J) to the pixels of the display panel through each of the scan lines. The third scan driving block 160 may generate the (2J+1)th through (3J)th scan signals SCAN(2J+1) through SCAN(3J) based on the operation of pixels in the display panel. In some example embodiments, the third scan driving block 160 may generate the (2J+1)th through (3J)th scan signals SCAN(2J+1) through SCAN(3J) having the first pulse. In other example embodiments, the third scan driving block 160 may generate the (2J+1)th through (3J)th scan signals SCAN(2J+1) through SCAN(3J) having the first pulse and the second pulse. Further, the third scan driving block 160 may provide a scan output signal S_OUT3 and a masking output signal M_OUT3 to a fourth scan driving block.

The scan driving blocks 120, 140, and 160 included in the scan driver 100 may generate the scan signals that include the first pulse or the first pulse and the second pulse and provide the scan signals to the pixels in the display panel through the scan lines.

As described above, the scan driver 100 of FIG. 1 may include the plurality of scan driving blocks 120, 140, and 160. Each of the scan driving blocks 120, 140, and 160 may generate the scan signals provided through at least one scan line. The scan signal may include the first pulse or the first pulse and second pulse based on the operation of the pixels. The scan driver 100 of FIG. 1 may improve a display quality by providing the scan signals having the first pulse or the scan signals having the first pulse and the second pulse based on the operation of the pixels.

Figure 2:
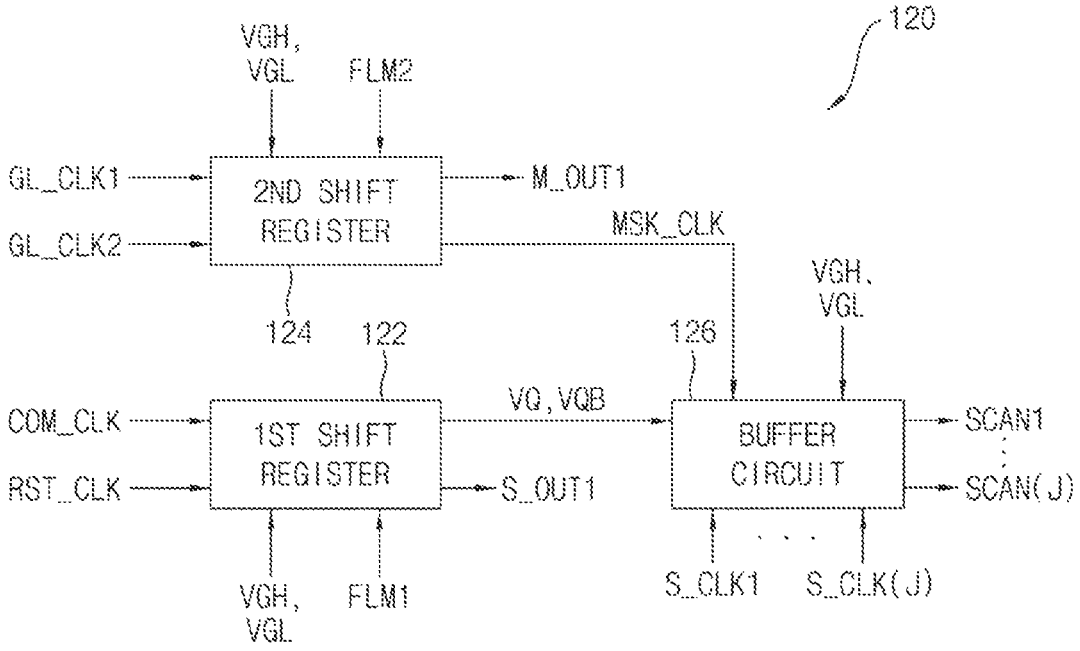
FIG. 2 is a block diagram illustrating a scan driving block included in the scan driver of FIG. 1.

FIG. 2 is a block diagram illustrating a scan driving block included in the scan driver of FIG. 1.

Referring to FIG. 2, the scan driving block 120 may include a first shift register 122, a second shift register 124, and a buffer circuit 126. FIG. 2 is a block diagram of the first scan driving block 120 among the plurality of scan driving blocks, and unlike the first scan driving block, other scan driving blocks 140 and 160 may receive a previous scan output signal S_OUT and a previous masking output signal M_OUT instead of a first start signal FLM1 and a second start signal FLM2.

The first shift register 122 may include a plurality of driving transistors. The first shift register 122 may provide a first driving signal VQ to a first driving node and a second driving signal VQB to a second driving node by turning on or turning off the driving transistors based on the first scan start signal FLM1 or the previous scan output signal S_OUT, and a plurality of driving clock signals COM_CLK and RST_CLK. The first shift register 122 may output the first driving signal VQ and the second driving signal VQB based on the first scan start signal FLM1 or the scan output signal S_OUT received from a first shift register of the previous scan driving block, the first driving clock signal COM_CLK, and the second driving clock signal RST_CLK. The first shift register 122 may output the first driving signal VQ and the second driving signal VQB based on the first scan start signal FLM1, the first driving clock signal COM_CLK, and the second driving clock signal RST_CLK when the first shift register 122 is included in the first scan driving block 120. The first shift register may output the first driving signal VQ and the second driving signal VQB based on the scan output signal S_OUT(N−1) received from a first shift register of an (N−1)th scan driving block, the first driving clock signal COM_CLK, and the second driving clock signal RST_CLK when the first shift register 122 is included in an Nth scan driving block 120, where the N is an integer equal to or greater than 2. Further, the first shift register included in the Nth scan driving block may provide a scan output signal S_OUT to a first shift register included in the (N+1)th scan driving block. The first shift register 122 that includes the driving transistors may be described in detail referring to FIGS. 3 and 4.

The second shift register 124 may include a plurality of masking transistors. The second shift register 124 may provide a masking signal MSL_CLK to a masking output node by turning on or turning off the masking transistors based on a second scan start signal FLM2 or the previous masking output signal M_OUT, and a plurality of masking clock signals GL_CLK1 and GL_CLK2. The second shift register 124 may output the masking signal MSK_CLK based on the second start signal FLM2 or masking output signal M_OUT received from a second register included in a previous scan driving block, a first masking clock signal GL_CLK1, and a second masking clock signal GL_CLK2. The second shift register 124 may output the masking signal MSK_CLK based on the second scan start signal FLM2, the first masking clock signal GL_CLK1, and the second masking clock signal GL_CLK2 when the second shift register 124 is included in the first scan driving block 120. The second shift register may output the masking signal MSK_CLK based on the masking output signal M_OUT received form the second shift register of an (N−1)th scan driving block, the first masking clock signal GL_CLK1, and the second masking clock signal GL_CLK2 when the second shift register is included in the Nth scan driving block, where the N is an integer equal to or greater than 2. Further, the second shift register included in the Nth scan driving block may provide the masking output signal M_OUT to a second register included in the (N+1)th scan driving block. The masking output signal M_OUT may be the same signal as the masking signal MSK_CLK provided to the masking output node. The second shift register 124 that includes the masking transistors may be described in detail referring to FIGS. 5 and 6.

The buffer circuit 126 may include a plurality of buffer transistors. The buffer circuit 126 may output the scan signals by turning on or turning off the buffer transistors based on the plurality of driving scan clock signals S_CLK1 through S_CLK(J), the first driving signal VQ, second driving signal VQB, and the masking signal MSK_CLK. The scan clock signals S_CLK1 through S_CLK(J) may include the first pulse and the second pulse. The buffer circuit 126 may control an output timing of the scan signals SCAN1 through SCAN(J) as which the scan clock signal S_CLK1 through S_CLK(J) are output based on the first driving signal VQ and the second driving signal VQB received from the first shift register 122. The buffer circuit 126 may mask the second pulse of the scan clock signals S_CLK1 through S_CLK(J) based on the masking signal MSK_CLK received form the second shift register 124. The buffer circuit 126 may output the scan signals SCAN1 through SCAN(J) that includes the first pulse or scan signals SCAN1 through SCAN(J) that includes the first pulse and the second pulse based on the masking signal MSK_CLK. In some example embodiments, the buffer transistors may be implemented as a p-channel metal-oxide semiconductor (PMOS). The buffer circuit 126 may output the scan signals SCAN1 through SCAN(J) that includes the first pulse when the masking signal MSK_CLK has a low level. Further, the buffer circuit 126 may output the scan signals SCAN1 through SCAN(J) that includes the first pulse and the second pulse when the masking signal MSK_CLK has a high level. In other example embodiments, the buffer transistors may be implemented as an n-channel metal-oxide semiconductor (NMOS). The buffer circuit may output the scan signals SCAN1 through SCAN(J) that includes the first pulse when the masking signal MSK_CLK has a high level. Further, the buffer circuit may output the scan signals SCAN1 through SCAN(J) that includes the first pulse and the second pulse when the masking signal MSK_CLK has a low level. The buffer circuit 126 that includes the buffer transistors may be described in detail referring to FIGS. 7, 8A, and 8B.

Here, a first power voltage VGH and a second power voltage VGL for driving the first shift register 122, the second shift register 124, and the buffer circuit 126 may be provided to each of the first shift register 122, the second shift register 124, and the buffer circuit 126. The first power voltage VGH and the second power voltage VGL may be generated in a power generator (not shown) of a display device and be provided to scan driver 100.

Figure 3:
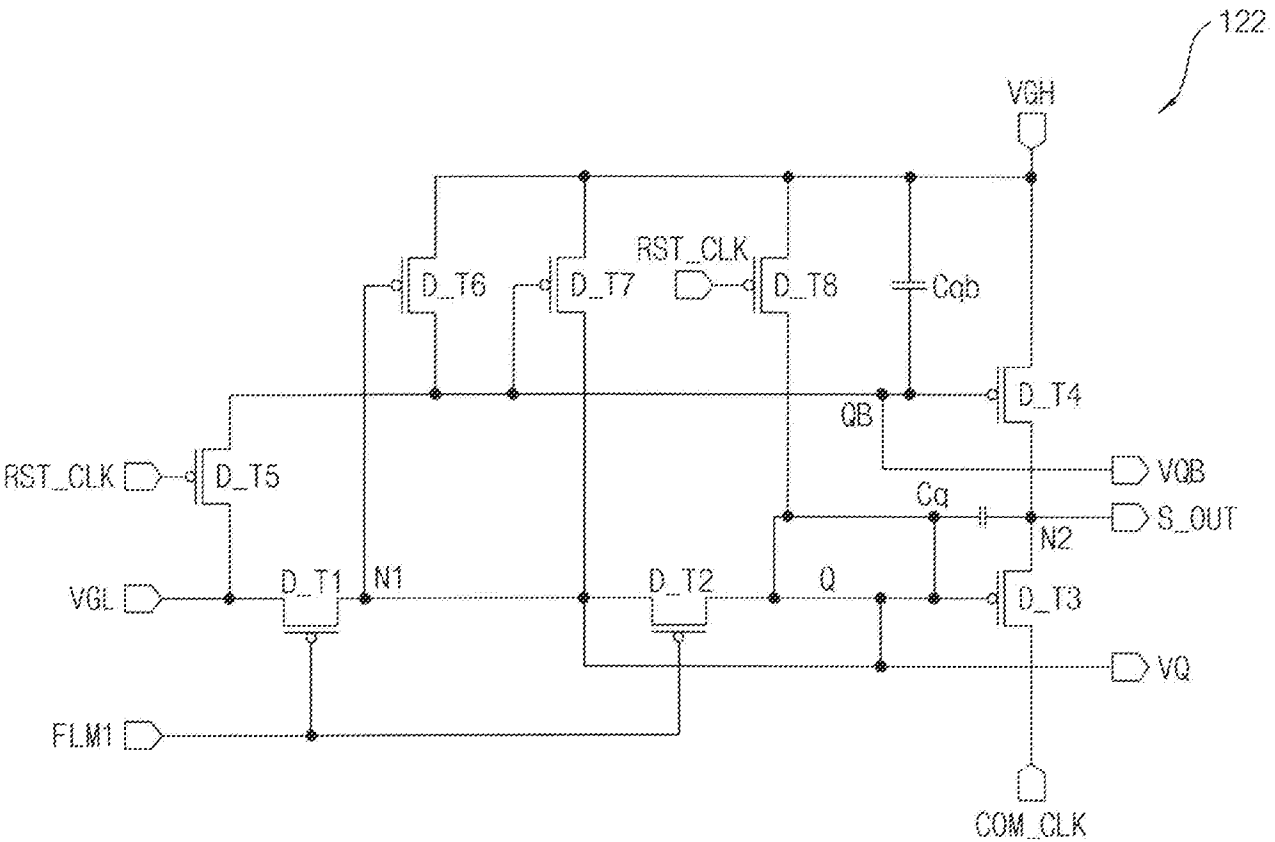
FIG. 3 is a circuit diagram illustrating a first shift register included in the scan driving block of FIG. 2.
Figure 4:
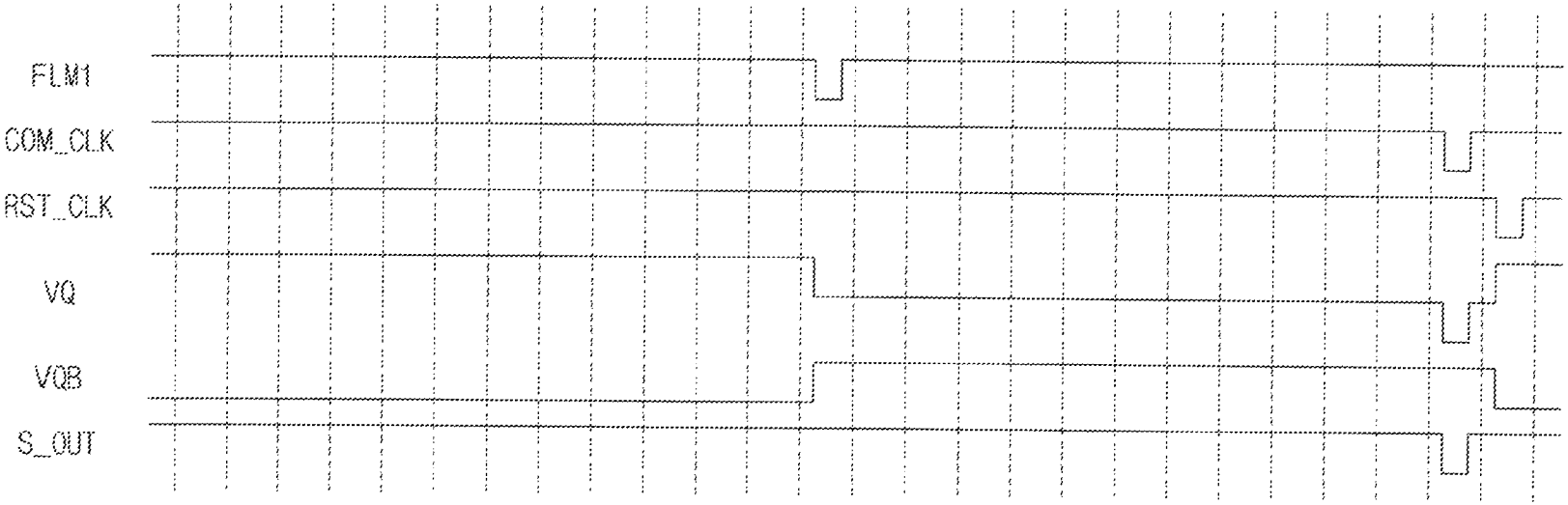
FIG. 4 is a timing diagram illustrating an operation of the first shift register of FIG. 3.

FIG. 3 is a circuit diagram illustrating the first shift register 122 included in the scan driving block 120 of FIG. 2, and FIG. 4 is a timing diagram illustrating an operation of the first shift register 122 of FIG. 3.

Referring to FIG. 3, the first shift register 122 may include a first driving transistor D_T1, a second driving transistor D_T2, a third driving transistor D_T3, a fourth driving transistor D_T4, a fifth driving transistor D_T5, a sixth driving transistor D_T6, a seventh driving transistor D_T7, an eighth driving transistor D_T8, a first capacitor Cq, and a second capacitor Cqb. FIG. 3 is the circuit diagram of the first shift register 122 included in the first scan driving block 120 among the plurality of scan driving blocks, and unlike the first shift register 122 included in the first scan driving block, the first shift register of other scan driving blocks may receive a previous scan output signal S_OUT instead of the first start signal FLM1.

The first driving transistor D_T1 may include a gate electrode that receives the first start signal FLM1, a first electrode that receives a second power voltage VGL, and a second electrode coupled to a first node N1. The second driving transistor D_T2 may include a gate electrode that receives the first start signal FLM1, a first electrode coupled to the first node N1, and a second electrode coupled to a first driving node Q. The third driving transistor D_T3 may include a gated electrode coupled to the first driving node Q, a first electrode coupled to a second node N2, and a second electrode receives the first driving clock signal COM_CLK. The fourth driving transistor D_T4 may include a gate electrode coupled to a second driving node QB, a first electrode that receives a first power voltage VGH, and a second electrode coupled to the second node N2. The fifth driving transistor D_T5 may include a gate electrode that receives the second driving clock signal RST_CLK, a first electrode coupled to the second driving node QB, and a second electrode that receives the second power voltage VGL. The sixth driving transistor D_T6 may include a gate electrode coupled to the first node N1, a first electrode that receives the first power voltage VGH, and a second electrode coupled to the second driving node QB. The seventh driving transistor D_T7 may include a gate electrode coupled to the second driving node QB, a first electrode that receives the first power voltage VGH, and a second electrode coupled to the first node N1. The eighth driving transistor D_T8 may include a gate electrode that receives the second driving clock signal RST_CLK, a first electrode that receives the first power voltage VGH, and a second electrode coupled to the first driving node Q. The first capacitor Cq may be coupled between the first driving node Q and the second node N2. The second capacitor Cqb may be couple between the second driving node QB and the first power voltage VGH.

The first through eighth driving transistors D_T1 through D_T8 may be implemented as PMOS transistors as described in FIG. 3. The first through eighth driving transistors D_T1 through D_T8 may turn on in response to a voltage having a low level (e.g., VGL) and turn off in response to a voltage having a high level (e.g., VGH). Although the first through eighth driving transistors D_T1 through D_T8 implemented as the PMOS transistors are described in FIG. 3, the first through eighth driving transistors D_T1 through D_T8 are not limited thereto. For example, the first through eighth driving transistors D_T1 through D_T8 may be implemented as NMOS transistors. In this case, the first through eighth driving transistors D_T1 through D_T8 may turn on in response to a voltage having a high level (e.g., VGH) and turn off in response to a voltage having a low level (e.g., VGL).

Referring to FIG. 4, the first driving voltage VQ of the first driving node Q may maintain the voltage having the low level and a second driving voltage VQB of the second driving node QB may maintain the voltage having the high level when the first start signal FLM1 having a low level is provided to the first shift register 122. Specifically, the first driving transistor D_T1 and the second driving transistor D_T2 may turn on when the first start signal FLM1 having the low level is provided. Further, the voltage of the first node N1 and the voltage of the first driving node Q may have the low level when the first start signal FLM1 having the low level is provided. As the voltage of the first node N1 has the low level, the sixth driving transistor D_T6 may turn on and the first power voltage VGH may be provided to the second driving node QB. Thus, the first shift register 122 may provide the first driving signal VQ having the low level and the second driving signal VQB having the high level to the buffer circuit 126. Further, as the voltage of the first driving node Q has the low level, the third driving transistor D_T3 may turn on, and the first driving clock signal COM_CLK having the high level may be provided to the second node N2. The voltage of the second node N2 may be provided to the first shift register 122 included in the next scan driving block as the scan output signal S_OUT.

The first driving voltage of the first driving node Q may fall when the first driving clock signal COM_CLK having the low level is provided to the first shift register 122. Specifically, the first driving clock signal COM_CLK having the low level may be provided to the second electrode of the third driving transistor D_T3, and the voltage of the first driving node Q may fall when the first driving clock signal COM_CLK having the low level is provided to the first shift register 122. Further, the scan output signal S_OUT having the low level may be output as the voltage of the second node N2 is fallen.

The first driving voltage VQ of the first driving node Q may have the high level, and the second driving voltage VQB of the second driving node QB may have the low level when the second driving clock signal RST_CLK having the low level is provided. Specifically, the fifth driving transistor D_T5 may turn on, and the voltage having the low level may be provided to the second driving node QB when the second driving clock signal RST_CLK having the low level is provided to the first register 122. Further, the first power voltage VGH may be provided to the first driving node Q as the eighth driving transistor D_T8 turns on, and the first driving node Q may have the high level. Thus, the first shift register 122 may provide the first driving signal VQ having the high level and the second driving signal VQB having the low level to the buffer circuit 126.

Figure 5:
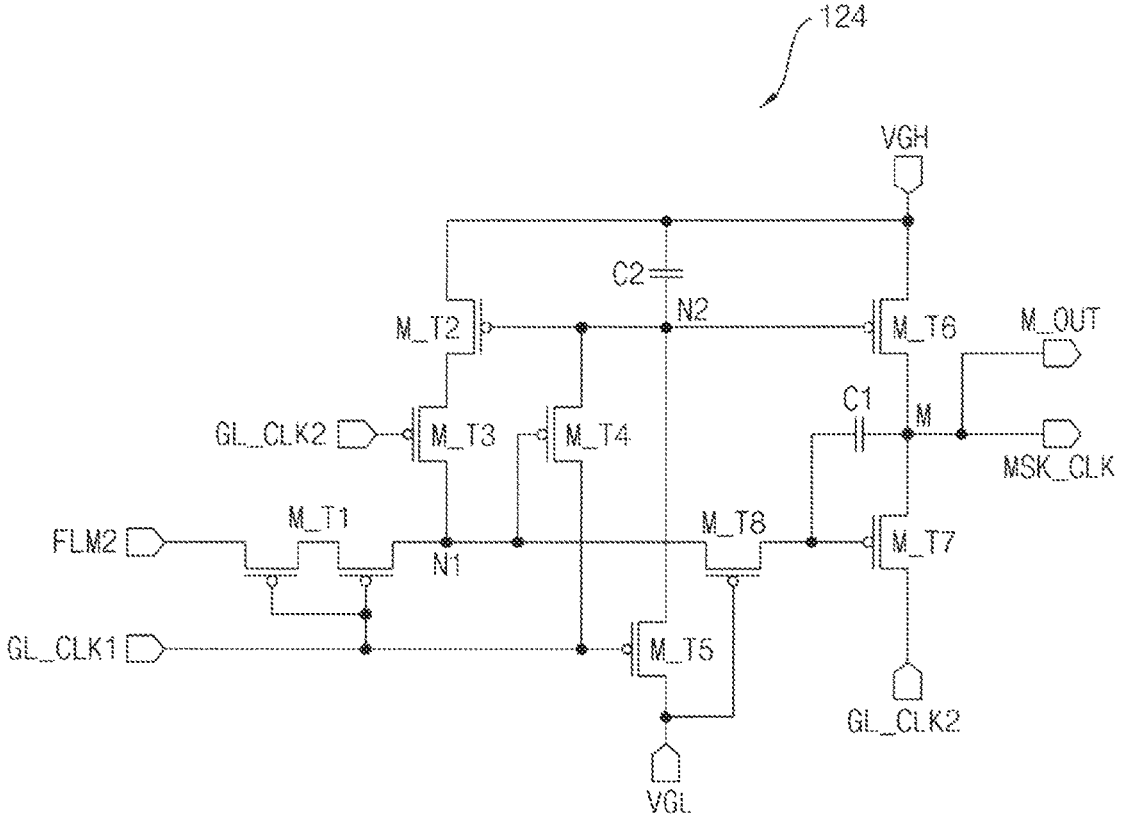
FIG. 5 is a circuit diagram illustrating a second shift register included in the scan driving block of FIG. 2.
Figure 6:
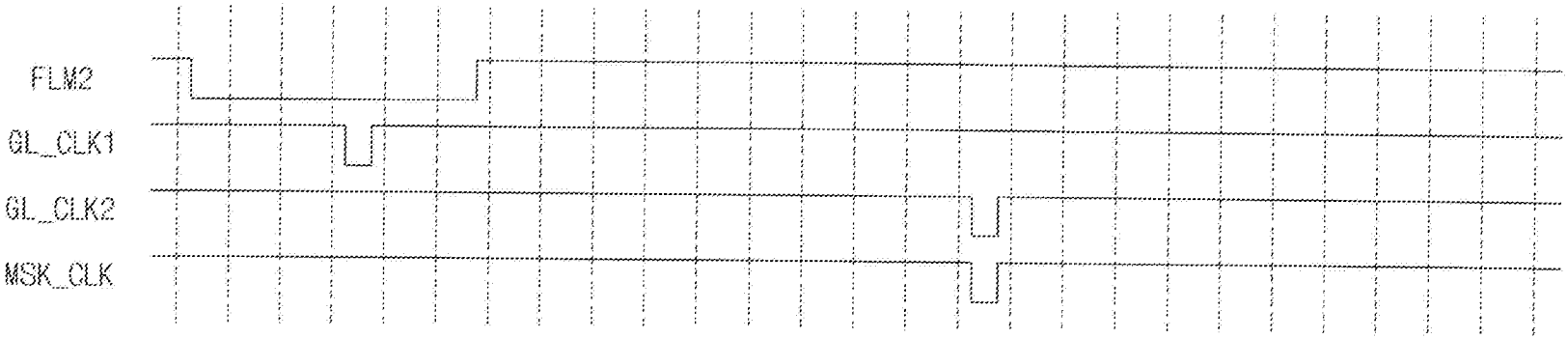
FIG. 6 is a timing diagram illustrating an operation of the second shift register of FIG. 5.

FIG. 5 is a circuit diagram illustrating the second shift register 124 included in the scan driving block 120 of FIG. 2, and FIG. 6 is a timing diagram illustrating an operation of the second shift register 124 of FIG. 5.

Referring to FIG. 5, the second shift register 124 may include a first masking transistor M_T1, a second masking transistor M_T2, a third masking transistor M_T3, a fourth masking transistor M_T4, a fifth masking transistor M_T5, a sixth masking transistor M_T6, a seventh masking transistor M_T7, an eighth masking transistor M_T8, a first capacitor C1, and a second capacitor C2. FIG. 5 is the circuit diagram of the second shift register 124 included in the first scan driving block 120 among the plurality of scan driving blocks, and unlike the second shift register 124 included in the first scan driving block, the second shift register of other scan driving blocks may receive a previous masking output signal M_OUT instead of the second start signal FLM2.

The first masking transistor M_T1 may include a gate electrode that receives the masking clock signal GL_CLK1, a first electrode that receives the second start signal FLM2, and a second electrode coupled to the first node N1. The second masking transistor M_T2 may include a gate electrode coupled to the second node N2, a first electrode that receives the first power voltage VGH, and a second electrode coupled to the third masking transistor M_T3. The third masking transistor M_T3 may include a gate electrode that receives the second masking clock signal GL_CLK2, a first electrode coupled to the second masking transistor M_T2, and a second electrode coupled to the first node N1. The fourth masking transistor M_T4 may include a gate electrode coupled to the first node N1, a first electrode coupled to the second node N2, and a second electrode that receives the first masking clock signal GL_CLK1. The fifth masking transistor M_T5 may include a gate electrode that receives the first masking clock signal GL_CLK1, a first electrode coupled to the second node N2, and a second electrode that receives the second power voltage VGL. The sixth masking transistor M_T6 may include a gate electrode coupled to the second node N2, a first electrode that receives the first power voltage VGH, and a second electrode coupled to the masking output node M. The seventh masking transistor M_T7 may include a gate electrode coupled to the eighth masking transistor M_T8, a first electrode coupled to the masking output node M, and a second electrode that receives the second masking clock signal GL_CLK2. The eighth masking transistor M_T8 may include a gate electrode that receives the second power voltage VGL, a first electrode coupled to the first node N1, and a second electrode coupled to the gate electrode of the seventh masking transistor M_T7. The first capacitor C1 may be coupled between the masking output node M and the eighth masking transistor M_T8. The second capacitor C2 may be coupled between a line that provides the first power voltage VGH and the second node N2.

The first through eighth masking transistors M_T1 through M_T8 may be implemented as PMOS transistors as described in FIG. 5. The first through eighth masking transistors M_T1 through M_T8 may turn on in response to a voltage having a low level (e.g., VGL) and turn off in response to a voltage having a high level (e.g., VGH). Although the first through eighth masking transistors M_T1 through M_T8 implemented as the PMOS transistors are described in FIG. 5, the first through eighth masking transistors M_T1 through M_T8 are not limited thereto. For example, the first through eighth masking transistors M_T1 through M_T8 may be implemented as NMOS transistors. In this case, the first through eighth masking transistors M_T1 through M_T8 may turn on in response to a voltage having a high level (e.g., VGH) and turn off in response to a voltage having a low level (e.g., VGL).

Referring to FIG. 6, the masking signal MSK_CLK may maintain the high level when the second start signal FLM2 having the low level and the first masking clock signal GL_CLK1 having the low level are provided to the second shift register 124. Specifically, the first masking transistor M_T1 may turn on, and the voltage of the first node N1 may have the low level when the second start signal FLM2 having the low level and the first masking clock signal GL_CLK1 having the low level are provided to the second shift register 124. The voltage of the first node N1 having the low level may be provided to the gate electrode of the seventh masking transistor M_T7 through the eighth masking transistor M_T8. Then, the seventh masking transistor M_T7 may turn on. Further, the fifth masking transistor M_T5 may turn on, and the voltage of the second node N2 may have high level. The sixth masking transistor M_T6 may turn off when the voltage of the second node N2 has the high level. Thus, the second masking clock signal GL_CLK2 having the high level may be provided to the masking output node M through the seventh masking transistor M_T7. The second shift register 124 may provide the voltage of the masking output node M to the buffer circuit 126 as the masking signal MSK_CLK. Alternately, the second shift register 124 may provide the voltage of the masking output node M to the second shift register of the next scan driving block as the masking output signal M_OUT.

The masking signal MSK_CLK may have the low level when second masking clock signal GL_CLK2 is provided to the second shift register 124. Specifically, the third masking transistor M_T3 and the seventh masking transistor M_T7 may turn on, and the second masking clock signal GL_CLK2 having the low level may be provided to the masking output node M when the second masking clock signal GL_CLK2 having the low level is provided to the second shift register 124. The second shift register 124 may provide the voltage of the masking output node M to the buffer circuit as the masking signal MSK_CLK. Alternately, the second shift register 124 may provide the voltage of the masking output node M to the second shift register of the next scan driving block as the masking output signal M_OUT.

Figure 7:
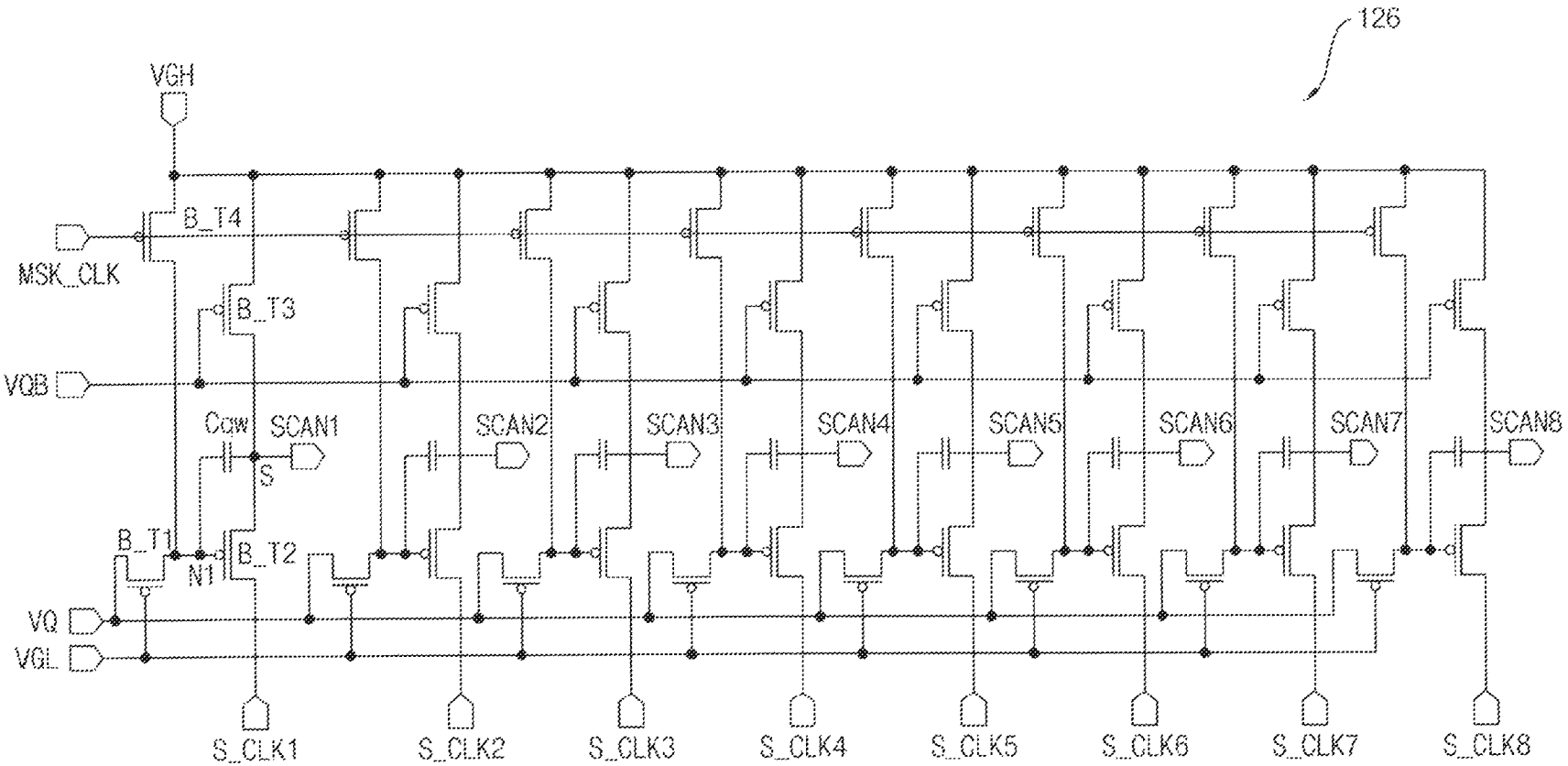
FIG. 7 is a circuit diagram illustrating a buffer circuit included in the scan driving block of FIG. 2.
Figure 8A:
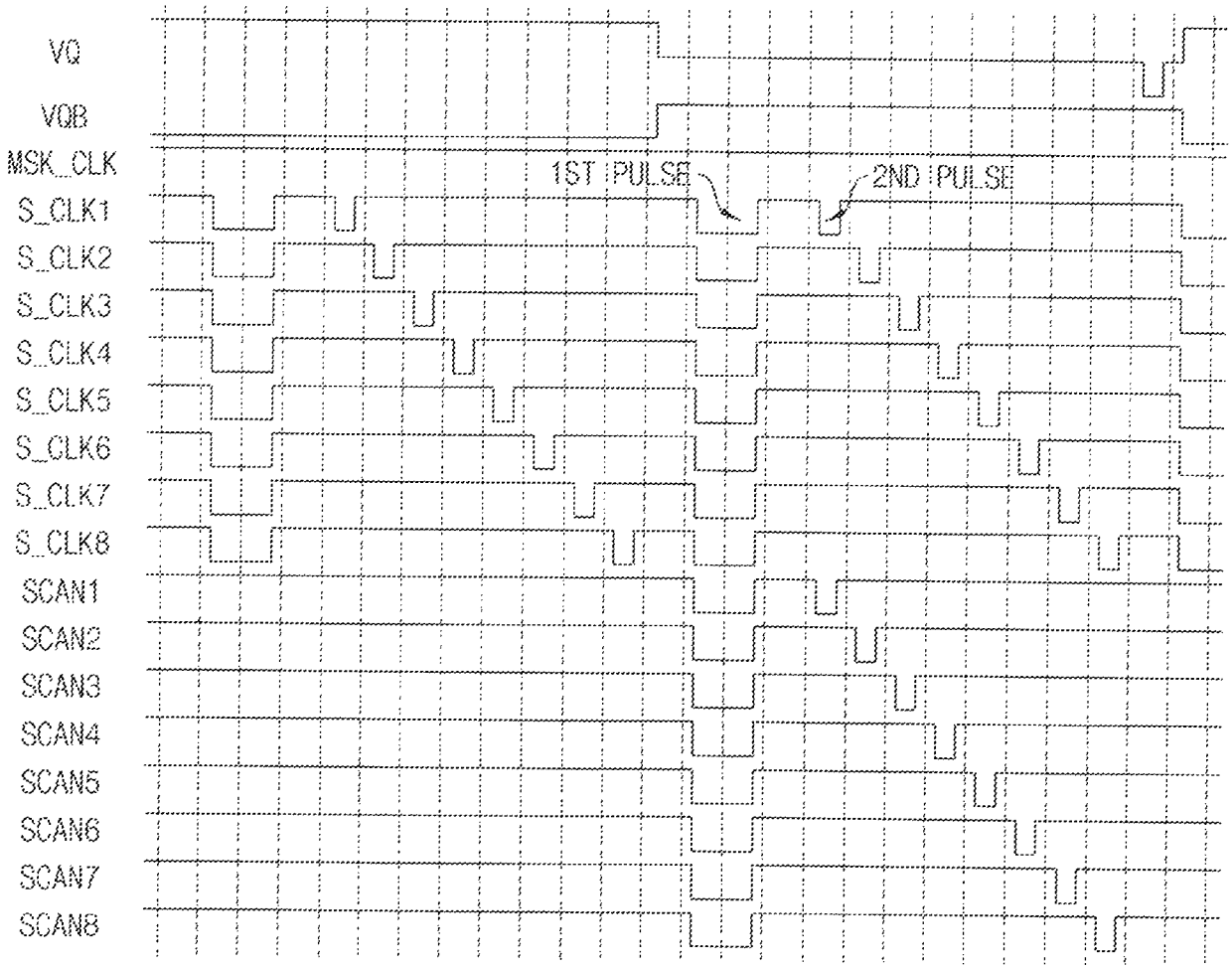
FIGS. 8A and 8B are a timing diagram illustrating an operation of the buffer circuit of FIG. 7.
Figure 8B:
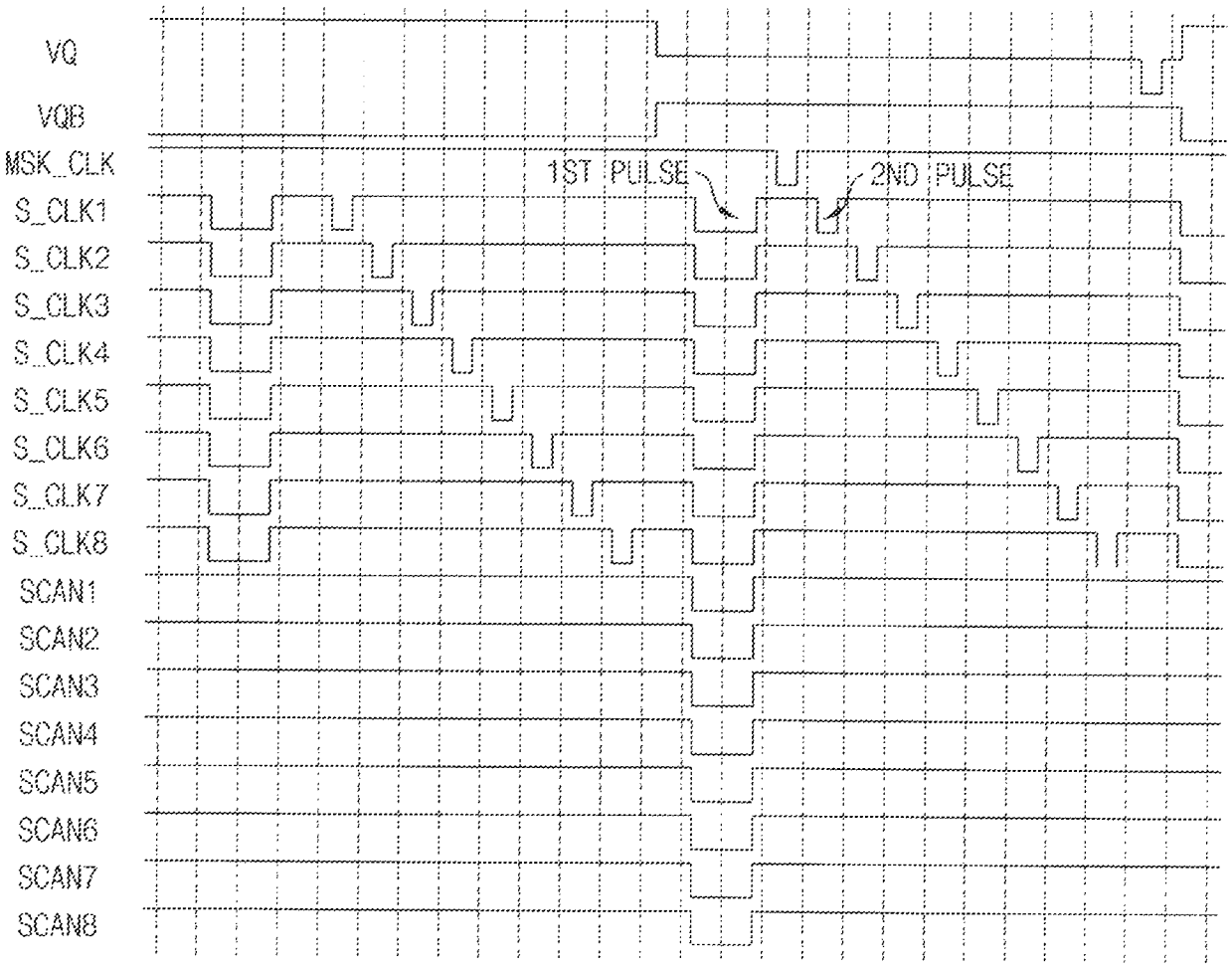

FIG. 7 is a circuit diagram illustrating the buffer circuit 126 included in the scan driving block 120 of FIG. 2, and FIGS. 8A and 8B are is a timing diagram illustrating an operation of the buffer circuit 126 of FIG. 7.

Referring to FIG. 7, the buffer circuit 126 may include a first buffer transistor B_T1, a second buffer transistor B_T2, a third buffer transistor B_T3, a fourth buffer transistor B_T4, and a capacitor Cgw.

The first buffer transistor B_T1 may include a gate electrode that receives the second power voltage VGL, a first electrode coupled to the first driving node Q of the first shift register 122, and a second electrode coupled to a first node N1. The second buffer transistor B_T2 may include a gate electrode coupled to the first node N1, a first electrode coupled to a scan output node S, and a second electrode that receives the first scan clock signal S_CLK1. The third buffer transistor B_T3 may include a first electrode coupled to the second driving node VQB of the first shift register 122, a first electrode that receives the first power voltage VGH, and a second electrode coupled to the scan output node S. The fourth buffer transistor B_T4 may include a gate electrode coupled to the masking output node M of the second shift register 124, a first electrode that receives the first power voltage VGH, and a second electrode coupled to the first node N1. The capacitor Cgw may be coupled between the first node N1 and the scan output node S.

The first through fourth buffer transistors B_T1 through B_T4 may be implemented as PMOS transistors as described in FIG. 7. The first through fourth buffer transistors B_T1 through B_T4 may turn on in response to a voltage having a low level (e.g., VGL) and turn off in response to a voltage having a high level (e.g., VGH). Although the first through fourth buffer transistors B_T1 through B_T4 implemented as the PMOS transistors are described in FIG. 7, the first through fourth buffer transistors B_T1 through B_T4 are not limited thereto. For example, the first through fourth buffer transistors B_T1 through B_T4 may be implemented as NMOS transistors. In this case, the first through fourth buffer transistors B_T1 through B_T4 may turn on in response to a voltage having a high level (e.g., VGH) and turn off in response to a voltage having a low level (e.g., VGL).

Referring to FIG. 8A, the buffer circuit 126 may output the scan signals SCAN1 through SCAN8 that include the first pulse and the second pulse when the first driving signal VQ having the low level, the second driving signal VQB having the high level, and the masking signal MSK_CLK having the high level are provided to the buffer circuit 126. Specifically, the first buffer transistor B_T1 and the second buffer transistor B_T2 may turn on when the first driving signal VQ having the low level is provided to the buffer circuit 126. Further, the third buffer transistor B_T3 and the fourth buffer transistor B_T4 may turn off when the second driving signal VQB having the high level and the masking signal MSK_CLK having the high level are provided to the buffer circuit 126. Thus, the scan clock signals S_CLK1 through S_CLK8 provided to the second electrode of the second buffer transistor B_T2 may be provided to the scan output node S and may be output as the scan signals SCAN1 through SCAN8. The scan signals SCAN1 through SCAN8 may include the first pulse and the second pulse as the scan clock signals S_CLK1 through S_CLK8 include the first pulse and the second pulse. Thus, buffer circuit 126 may output the scan signals SCAN1 through SCAN8 that include the first pulse and the second pulse.

Referring to FIG. 8B, the buffer circuit 126 may output the scan signals SCAN1 through SCAN8 that include the first pulse when the first driving signal VQ having the low level, the second driving signal VQB having the high level, and the masking signal MSK_CLK having the low level are provided to the buffer circuit 126. Specifically, the first buffer transistor B_T1 and the second buffer transistor B_T may turn on when the first driving signal VQ having the low level is provided to the buffer circuit 126. Further, the third buffer transistor B_T3 and the fourth buffer transistor B_T4 may turn off when the second driving signal VQB having the high level and the making signal MSK_CLK having the high level are provided. Thus, the scan clock signals S_CLK1 through S_CLK8 provided to the second electrode of the second buffer transistor B_T2 may be provided to the scan output node S and output as the scan signals SCAN1 through SCAN8 while the masking signal MSK_CLK has the high level. The fourth buffer transistor B_T4 may turn on, and the first power voltage VGH having the high level may be provided to the first node N1 when the masking signal MSK_CLK having the low level is provided to the buffer circuit 126. The voltage of the scan output node S may have the high level by the second buffer transistor B_T2 that turns off when the voltage having the high level is provided to the first node N1. That is, the second pulse of the scan clock signals S_CLK1 through S_CLK8 may be masked by the masking signal MSK_CLK. Thus, the buffer circuit 126 may output the scan signals SCAN1 through SCAN8 that include only the first pulse.

Figure 9:
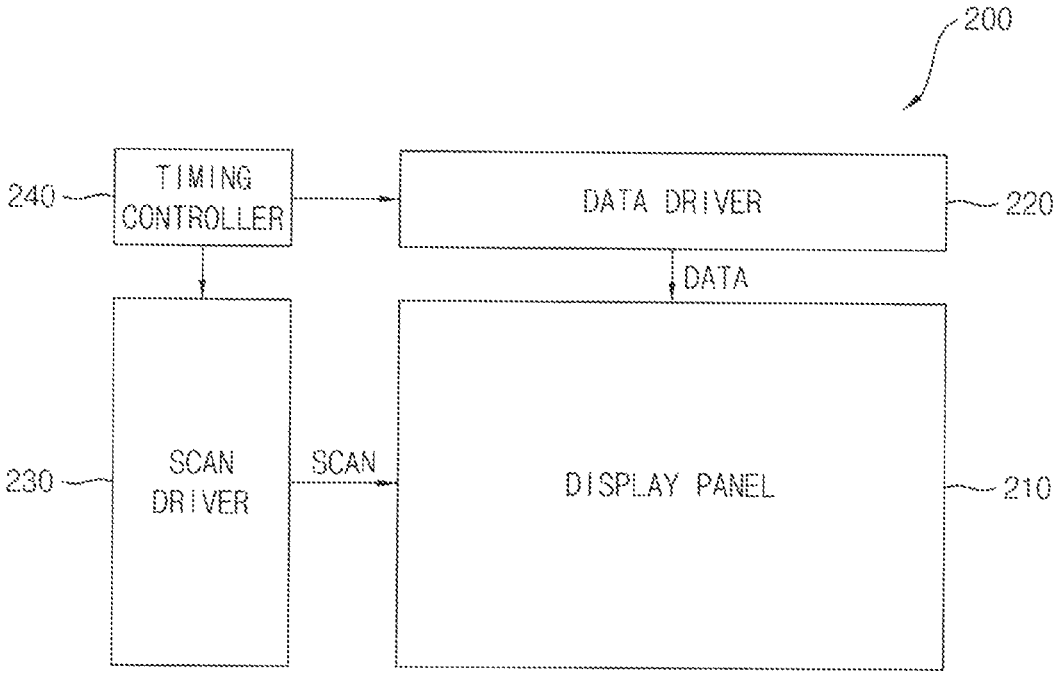
FIG. 9 is a block diagram illustrating a display device, according to example embodiments.
Figure 10:
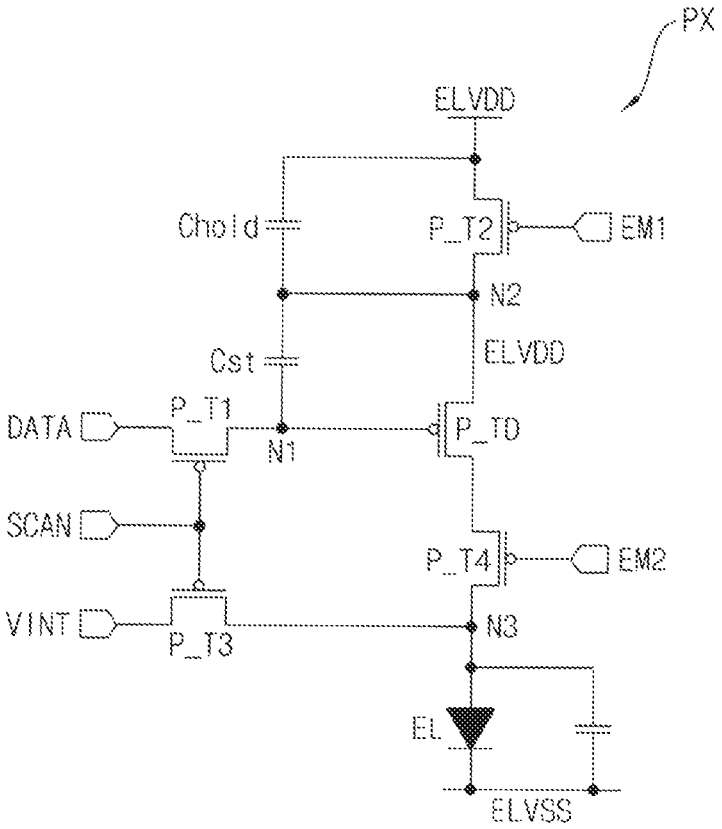
FIG. 10 is a circuit diagram illustrating an example of a pixel circuit included in the display device of FIG. 9.

FIG. 9 is a block diagram illustrating a display device, according to example embodiments, and FIG. 10 is a circuit diagram illustrating an example of a pixel circuit included in the display device of FIG. 9.

Referring to FIG. 9, a display device 200 may include a display panel 210, a data driver 220, a scan driver 230, and a timing controller 240.

A plurality of data lines and a plurality of scan lines may be formed on the display panel 210. A plurality of pixels PX may be formed in intersection regions of the data lines and the scan lines.

Referring to FIG. 10, the pixel PX may include a pixel driving transistor P_TD, a first switching transistor P_T1, a second switching transistor P_T2, a third switching transistor P_T3, a fourth switching transistor P_T4, a first capacitor Chold, a second capacitor Cst, and an organic light emitting diode EL.

The pixel driving transistor P_TD may include a gate electrode coupled to a first node N1, a first electrode coupled to a second node N2, and a second node coupled to the fourth switching transistor P_T4. The pixel driving transistor P_TD may control an amount of current flowing throw the organic emitting diode EL corresponding to a voltage provided to the first node N1. The first switching transistor P_T1 may include a gate electrode coupled to a scan line, a first electrode coupled to a data line, and a second electrode coupled to the first node N1. The first switching transistor P_T1 may turn on and provide the data signal DATA provided through the data line to the first node N1 when the scan signal SCAN having the low level is provided through the scan line. The second switching transistor P_T2 may include a gate electrode coupled to a first emission control line, a first electrode coupled to a high-power voltage line, and a second electrode coupled to a second node N2. The second switching transistor P_T2 may turn on and electrically couple the high-power voltage line and the second node N2 when a first emission control signal EM1 having the low level is provided through the first emission control line. The third switching transistor P_T3 may include a gate electrode coupled to the scan line, a first electrode coupled to an initialization voltage line, and a second electrode coupled to a third node N3. The third switching transistor P_T3 may turn on and provide an initialization voltage VINT provided through the initialization voltage line to the first node N1 when the scan signal SCAN having the low level is provided through the scan line. The initialization voltage VINT may have a voltage level that turns off the organic light emitting diode EL. The fourth switching transistor P_T4 may have a gate electrode coupled to a second emission control line, a first electrode coupled to the pixel driving transistor P_TD, and a second electrode coupled to the third node N3. The fourth switching transistor P_T4 may turn on and electrically couple the pixel driving transistor P_TD and the third node N3 when the second emission control signal EM2 having the low level is provided through the second emission control line. The first capacitor Chold and the second capacitor Cst may be serially coupled between the first node N1 and the high-power voltage line. The first capacitor Chold may have a first electrode coupled to the high-power voltage line and a second electrode coupled to the second node N2. The second capacitor Cst may have a first electrode coupled to the second node N2 and a second electrode coupled to the first node N1. The first capacitor Chold and the second capacitor Cst may store the voltage corresponding to a threshold voltage of the pixel driving transistor P_TD and the data signal DATA.

The pixel driving transistor P_TD and the first through fourth switching transistor P_T1 through P_T4 may be implemented as PMOS transistors as described in FIG. 10. The pixel driving transistor P_TD and the first through fourth switching transistor P_T1 through P_T4 may turn on in response to a voltage having a low level (e.g., VGL) and turn off in response to a voltage having a high level (e.g., VGH). Although the pixel driving transistor P_TD and the first through fourth switching transistor P_T1 through P_T4 implemented as the PMOS transistors are described in FIG. 10, the pixel driving transistor P_TD and the first through fourth switching transistor P_T1 through P_T4 are not limited thereto. For example, the pixel driving transistor P_TD and the first through fourth switching transistor P_T1 through P_T4 may be implemented as NMOS transistors. In this case, the pixel driving transistor P_TD and the first through fourth switching transistor P_T1 through P_T4 may turn on in response to a voltage having a high level (e.g., VGH) and turn off in response to a voltage having a low level (e.g., VGL). An operation of a pixel circuit may be described in detail referring to FIGS. 11 through 12.

The data driver 220 may provide the data signal DATA to the display panel 210 through the plurality of data lines.

The scan driver 230 may include a plurality of scan driving blocks that provide the scan signal SCAN to the display panel 210 through the plurality of scan lines. The scan driver 230 may include the plurality of scan driving blocks. Each of the scan driving blocks may be coupled to one or more scan lines. The scan driving blocks may generate the scan signal SCAN and provide the scan signal SCAN to the display panel 210 through the plurality of scan lines. For example, one scan driving block may be coupled to 8 scan lines. The scan driving block may provide the scan signals SCAN through each of the 8 scan lines. Each of the scan blocks may provide the scan signals that include a first pulse, or the scan signals that include a first pulse and a second pulse. When the pixels PX in the display panel 210 include the pixel driving transistor P_TD and the first through fourth switching transistors P_T1 through P_T4 implemented as PMOS transistors, the first pulse and the second pulse may have a low level (e.g., VGL). When the pixels PX in the display panel 210 include the pixel driving transistor P_TD and the first through fourth switching transistors P_T1 through P_T4 implemented as NMOS transistors, the first pulse and the second pulse may have a high level (e.g., VGH). Specifically, each of the scan driving blocks may include a first shift register, a second shift register, and a buffer circuit. The first shift register may include a plurality of driving transistors. The first shift register may provide a first driving signal to a first driving node and a second driving signal to a second driving node by turning on or turning off the driving transistors based on a first scan start signal or a previous scan output signal, and a plurality of driving clock signals. The second shift register may include a plurality of masking transistors. The second shift register may provide a masking signal to an output node by turning on or turning of the masking transistors based on a second scan start signal or a previous masking output signal, and a plurality of masking clock signals. The buffer circuit may include a plurality of buffer transistors. The buffer circuit may provide the scan signals SCAN by turning on or turning off the buffer transistors based on a plurality of scan clock signals that include the first pulse and the second pulse, the first driving signal, the second driving signal, and a masking signal. The buffer circuit may output the scan signal SCAN that includes the first pulse or the scan signal SCAN that includes the first pulse and the second pulse based on the masking signal. In some example embodiments, the buffer transistors in the buffer circuit may be implemented as PMOS transistors. The scan signal SCAN that includes the first pulse may output when the masking signal having the low level is provided to the buffer circuit. Further, the scan signal SCAN that includes the first pulse and the second pulse may output when the masking signal having the high level is provided to the buffer circuit. In other example embodiments, the buffer transistors in the buffer circuit may be implemented as the NMOS transistors. The scan signal SCAN that includes the first pulse may output when the masking signal having the high level is provided to the buffer circuit. Further, the scan signal SCAN that includes the first pulse and the second pulse may output when the masking signal having the low level is provided to the buffer circuit.

The timing controller 240 may control the data driver 220 and the scan driver 230. The timing controller 240 may divide one frame into a plurality of periods. In some example embodiments, each of the scan driving blocks of the scan driver 230 may output the scan signal SCAN that includes the first pulse in a partial period among the plurality of periods. In other example embodiments, each of the scan driving blocks of the scan driver 230 may output the scan signal SCAN that includes the first pulse and the second pulse in a partial period among the plurality of periods. For example, in the case where the scan signal SCAN includes the first pulse and the second pulse, the gate electrode of the pixel driving transistor P_TD included in the pixels PX coupled to the scan line may be initialized while the first pulse is provided through the scan line, and the data signal DATA provided through the data line may be written on the pixels PX that are coupled to the scan line while the second pulse is provided through the scan line.

As described above, the display device 200 of FIG. 9 may include the scan driver 230 for providing the scan signal SCAN that includes the first pulse or the scan signal SCAN that includes the first pulse and the second pulse. The display device 200 may improve a display quality by providing the scan signal SCAN that includes the first pulse or the scan signal SCAN that includes the first pulse and the second signal based on an operation of the pixels PX.

Figure 11:
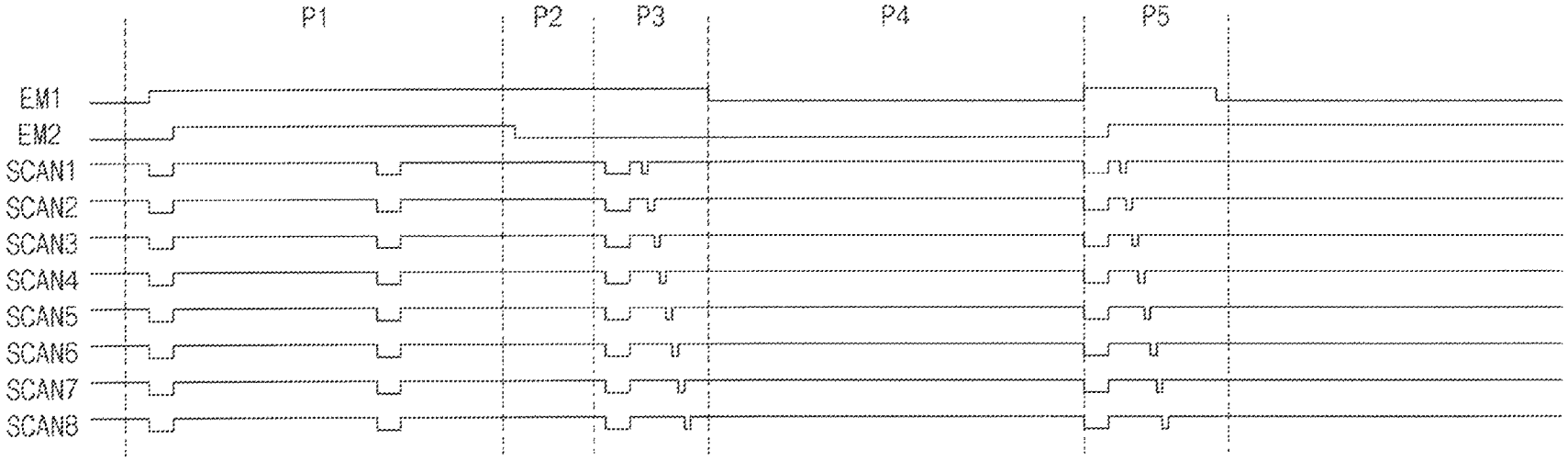
FIG. 11 is a timing diagram illustrating an operation of the pixel circuit.
Figure 12A:
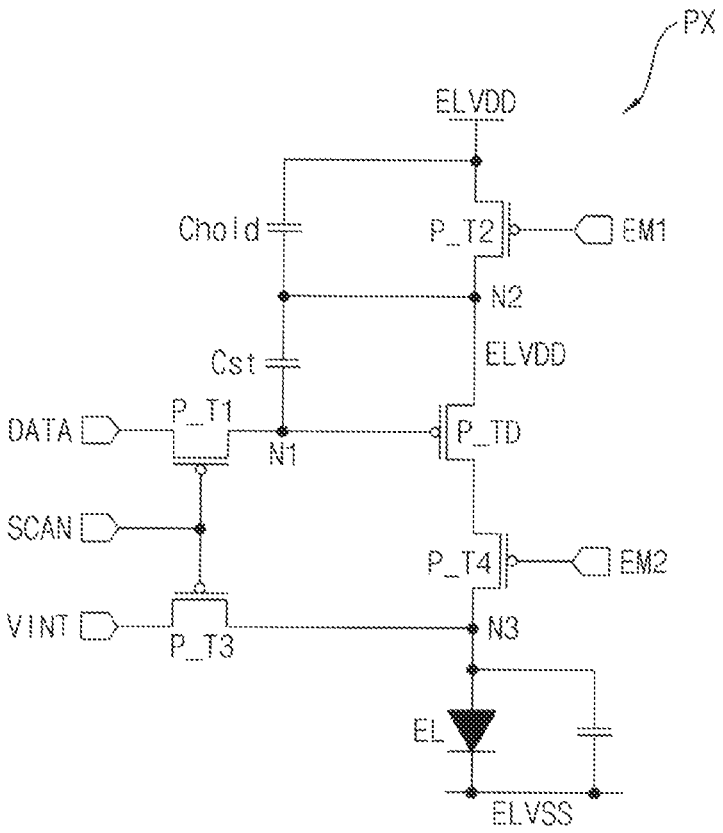
FIGS. 12A, 12B, 12C, 12D and 12E are diagrams illustrating an example of an operation of the pixel based on the timing diagram of FIG. 10.
Figure 12B:
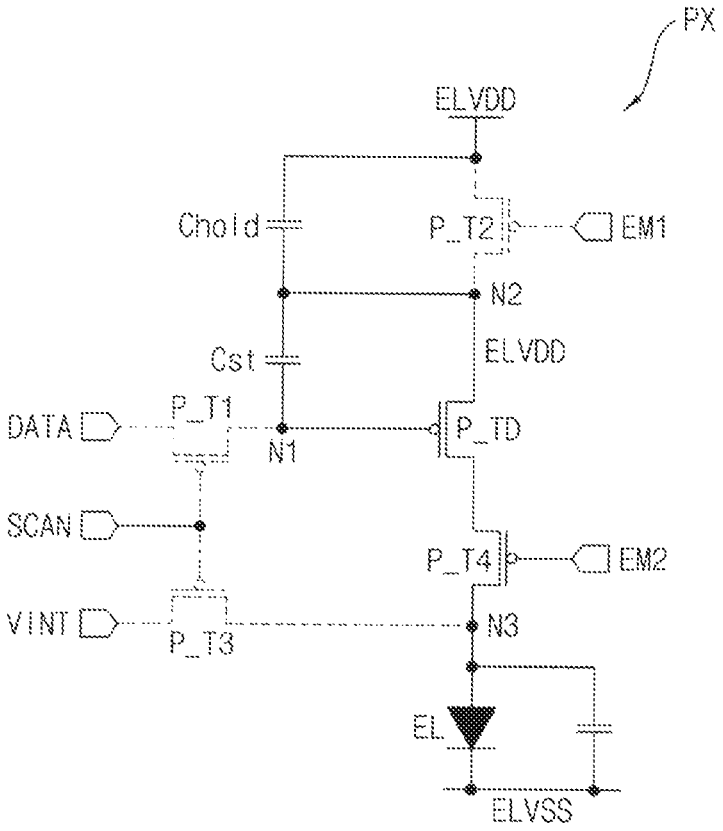
Figure 12C:
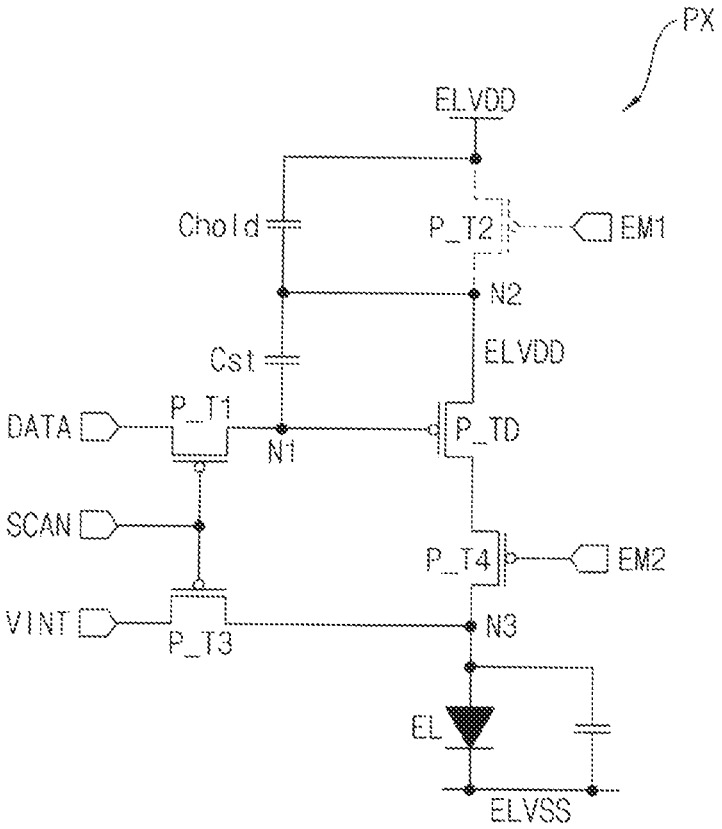
Figure 12D:
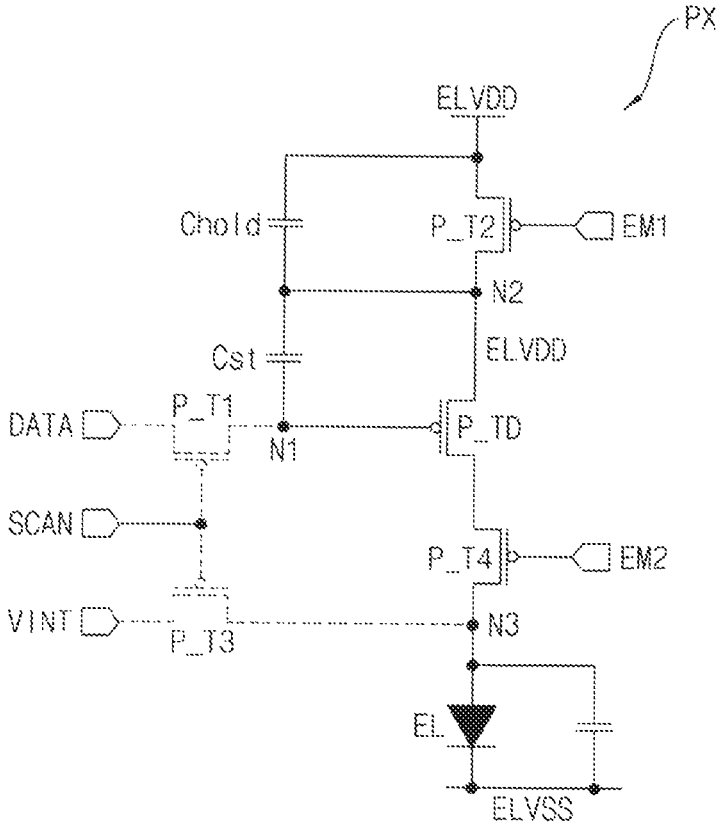
Figure 12E:
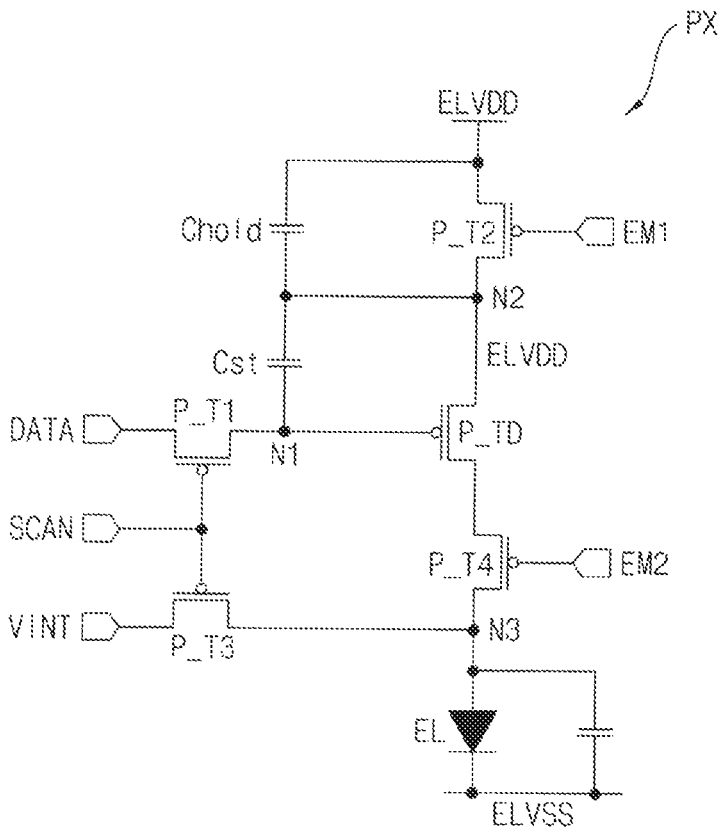

FIG. 11 is a timing diagram illustrating an operation of the pixel circuit, and FIGS. 12A through 12E are diagrams illustrating an example of an operation of the pixel based on the timing diagram of FIG. 10.

Referring to FIG. 11, the timing controller may divide one frame into a first period P1, a second period P2, a third period P3, a fourth period P4, and a fifth period P5.

First through eighth scan signal SCAN1 through SCAN8 that includes the first pulse may be received from a first scan driving block of the scan driver during the first period P1. The first switching transistor P_T1 and the third switching transistor P T may turn on when the first pulse having the low level is provided to the pixels PX as described in FIG. 12A. Further, the second switching transistor P_T2 and the fourth switching transistor P_T4 may turn on in response to the first emission control signal EM1 having the low level and the second emission control signal EM2 having the low level during the first period P1. Thus, the high-power voltage ELVDD may be provided to the second node N2, a reference voltage provided through the data line may be provided to the first node N1, and the initialization voltage VINT may be provided to the third node N3.

The second emission control signal EM2 having the low level may be provided during the second period P2. The fourth switching transistor P_T4 may turn on as described in FIG. 12B. Thus, the voltage of the second node N2 may fall to the low-power voltage ELVSS.

The first through eighth scan signals SCAN1 through SCAN8 that include the first pulse and the second pulse may be received from the first scan driving block of the scan driver during the third period P3. The first switching transistor P_T1 and the third switching transistor P_T3 may turn on in response to the first pulse having the low level and the second pulse having the low level during the third period P3 as described in FIG. 12C. Further, the fourth switching transistor P_T4 may turn on in response to the second emission control signal EM2 having the low level during the third period P3. The first switching transistor P_T1 may turn on, and the reference voltage provided through the data line may be provided to the first node N1. The voltage of the second node N2 may fall below the voltage of the first node N1 because of a coupling phenomenon. Further, the third switching transistor P_T3 may turn on and the initialization voltage VINT may be provided to the third node N3.

The first emission control signal EM1 having the low level and the second emission control signal EM2 having the low level may be provided during the fourth period P4. The second switching transistor P_T2 and the fourth switching transistor P_T4 may turn on as described in FIG. 12D. A gate-source voltage of the pixel driving transistor P_TD may be in an off region, and the current may not flow.

The first through eighth scan signals SCAN1 through SCAN8 that include the first pulse and the second pulse may be provided to the pixels PX during the fifth period P5. The third switching transistor P_T3 may turn on in response to the first pulse and may initialize the third node N3 as the initialization voltage VINT as described in FIG. 12E. The first switching transistor P_T1 may turn on in response to the first pulse and may compensate a threshold voltage of the pixel driving transistor P_TD. The pixel driving transistor P_TD may be initialized at the same time because the first pulses are provided to the scan lines that are coupled to the scan driving block. Further, the first switching transistor P_T1 may turn on in response to the second pulse and may provide the data signal DATA through the data line to the first node N1. The data signal may be sequentially written in the pixels PX that are coupled to the scan lines because the second pulses are sequentially provided to the scan lines that are coupled to the scan driving block. The first emission control signal EM1 having the low level and the second emission control signal EM2 having the low level may be provided to the pixels PX during the fifth period P5. The second switching transistor P_T2 and the fourth switching transistor P_T4 may turn on. Thus, the driving current generated in the pixel driving transistor P_TD may flow to the organic light emitting diode EL. The organic light emitting diode EL may emit light based on the driving current.

As described above, the pixels PX of the display panel 210 may receive the scan signals that include the first pulse during the first period P1 and the scan signals that include the first pulse and the second pulse during the third period P3 and the fifth period P5. In the case where the pixels PX receive the scan signal SCAN that includes the first pulse and the second pulse in the first period P1, a garbage data may be provided to the first node N1 of the pixels PX when the second pulse is applied. Thus, a defective image (e.g., ghost phenomenon) may be displayed on the display panel because the voltage of the second node N2 may not be discharged enough. The scan driving block according to example embodiments may avoid such defects by providing the scan signal SCAN that includes the first pulse during the first period P1 and providing the scan signal SCAN that includes the first pulse and the second pulse during the third period P3 and the fifth period P5. Therefore, a display quality of the display panel may be improved.

Figure 13:
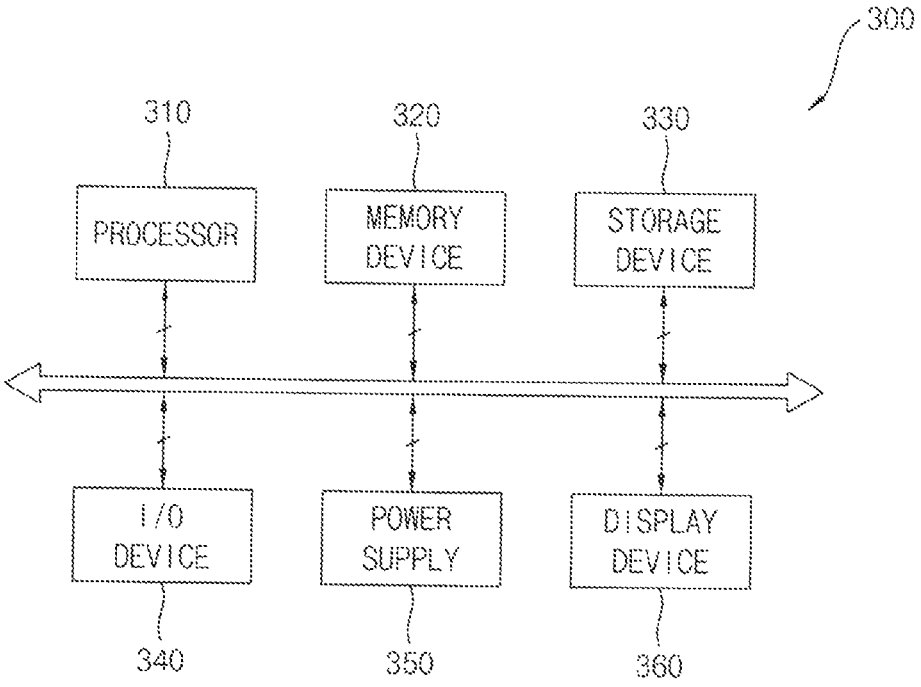
FIG. 13 is a block diagram illustrating an electronic device, according to example embodiments.
Figure 14:
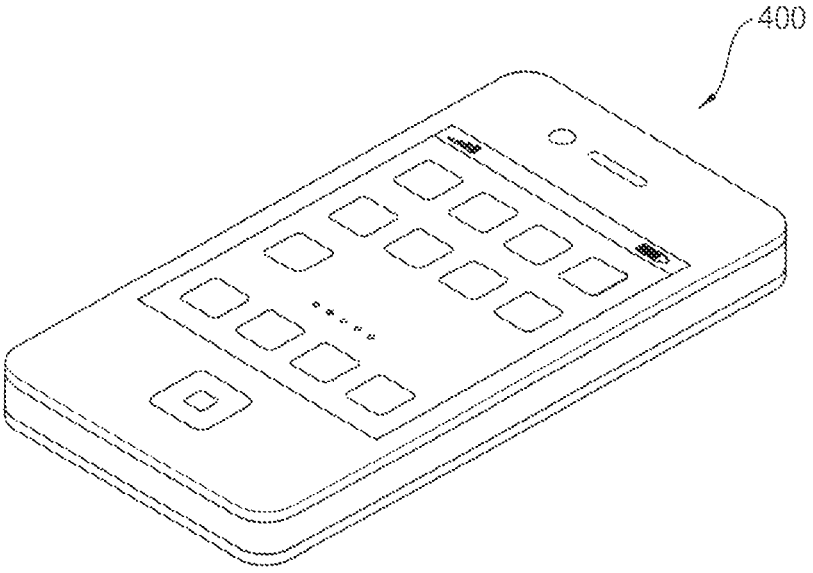
FIG. 14 is a diagram illustrating an example embodiment in which the electronic device of FIG. 13 is implemented as a smart phone.

FIG. 13 is a block diagram illustrating an electronic device, according to example embodiments, and FIG. 14 is a diagram illustrating an example embodiment in which the electronic device of FIG. 13 is implemented as a smart phone.

Referring to FIG. 13, an electronic device 300 may include a processor 310, a memory device 320, a storage device 330, an input/output (I/O) device 340, a power device 350, and a display device 360. The display device 360 may correspond to the display device 200 of FIG. 9. In addition, the electronic device 300 may further include a plurality of ports for communicating with a video card, a sound card, a memory card, a universal serial bus (USB) device, and other electronic devices. Although it is illustrated in FIG. 13 that the electronic device 300 is implemented as a smart phone 400, the electronic device 300 is not limited thereto, and the electronic device may be implemented as various other types of electronic devices without deviating from the scope of the present disclosure.

The processor 310 may perform various computing functions. The processor 310 may be a micro processor, a central processing unit (CPU), etc. The processor 310 may be coupled to other components via an address bus, a control bus, a data bus, etc. Further, the processor 310 may be coupled to an extended bus such as peripheral component interconnect (PCI) bus. The memory device 320 may store data for operations of the electronic device 300. For example, the memory device 320 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 330 may be a solid stage drive (SSD) device, a hard disk drive (HDD) device, a CD-ROM device, etc.

The I/O device 340 may be an input device such as a keyboard, a keypad, a touchpad, a touch-screen, a mouse, etc., or an output device such as a printer, a speaker, etc. In some example embodiments, the display device 360 may be included in the I/O device 340. The power device 350 may provide power for operations of the electronic device 300. The display device 360 may communicate with other components via the buses or other communication links. As described above, the display device 360 may include a display panel, a data driver, a scan driver, and a timing controller. A plurality of scan lines and a plurality of data lines may be formed on the display panel. A plurality of pixels may be formed in intersection regions of the data lines and the scan lines. The scan driver may include a scan driving blocks that provide a scan signal to the display panel through the plurality of scan lines. Each of the scan driving blocks may be coupled to the plurality of scan lines. The scan driving blocks may generate the scan signals and provide the scan signals through the plurality of scan liens. Each of the scan driving blocks may output the scan signal that includes a first pulse or the scan signal that includes a first pulse and a second pulse. The data driver may provide a data signal to the display panel through the plurality of data lines. The timing controller may control the data driver and the scan driver. The timing controller may divide one frame into a plurality of periods. In some example embodiments, each of the scan driving blocks of the scan driver may output the scan signal that includes the first pulse in a partial period among the plurality of periods. In other example embodiments, each of the scan driving blocks of the scan driver may output the scan signal that includes the first pulse and the second pulse in a partial period among the plurality of periods.

As described above, the electronic device 300 according to example embodiments may include the display device 360 having the scan driver. The scan driver outputs the scan signal that include the first pulse or the scan signal that include the first pulse and the second pulse. The display device 360 may avoid defects such as a ghost phenomenon by providing the scan signals that include the first pulse or the scan signals that include the first pulse and the second pulse based on an operation of the pixels. Thus, a display quality of the display device 360 may be improved.

The present disclosure may be applied to a display device and an electronic device having the display device. For example, the present disclosure may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art would readily appreciate that many modifications and deviations are possible in the example embodiments without materially departing from the novel teachings and advantages of the present disclosure. Accordingly, such modifications and deviations are intended to be included within the scope of the present disclosure. Therefore, it is to be understood that modifications to the disclosed example embodiments, as well as other example embodiments, are intended to be included within the scope of the appended claims.

What is claimed is:

1. A scan driver including a plurality of scan driving blocks, wherein each of the plurality of scan driving blocks comprising:

a first shift register including a plurality of driving transistors, the first shift register being configured to provide a first driving signal to a first driving node and to provide a second driving signal to a second driving node by turning on or turning off the plurality of driving transistors based on a first scan start signal or a previous scan output signal, and a plurality of driving clock signals;

a second shift register including a plurality of masking transistors, the second shift register being configured to provide a masking signal to a masking output node by turning on or tuning off the plurality of masking transistors based on a second scan start signal or a previous masking output signal, and a plurality of masking clock signals; and a buffer circuit including a plurality of buffer transistors, the buffer circuit being configured to provide scan signals by turning on or tuning off the plurality of buffer transistors based on a plurality of scan clock signals that include a first pulse and a second pulse, the first driving signal, the second driving signal, and the masking signal, wherein the buffer circuit outputs the scan signals that include the first pulse or the scan signals that include the first pulse and the second pulse based on the masking signal.

2. The scan driver of claim 1, wherein the buffer transistors are p-channel metal-oxide semiconductor (PMOS) transistors.

3. The scan driver of claim 2, wherein the buffer circuit outputs the scan signals that include the first pulse when the masking signal has a low level.

4. The scan driver of claim 2, wherein the buffer circuit outputs the scan signals that include the first pulse and the second pulse when the masking signal has a high level.

5. The scan driver of claim 1, wherein the buffer transistors are n-channel metal-oxide semiconductor (NMOS) transistors.

6. The scan driver of claim 5, wherein the buffer circuit outputs the scan signals that include the first pulse when the masking signal has a high level.

7. The scan driver of claim 5, wherein the buffer circuit outputs the scan signals that include the first pulse and the second pulse when the masking signal has a low level.

8. A display device comprising:

a display panel including a plurality of pixel circuits;

a data driver configured to provide a data signal to the display panel through a plurality of data lines;

a scan driver including a plurality of scan driving blocks that provide a scan signal to the display panel through a plurality of scan lines; and a timing controller configured to control the data driver and the scan driver, wherein each of the scan driving blocks outputs the scan signal that includes a first pulse or the scan signal that includes the first pulse and a second pulse, wherein each of the scan driving blocks includes:

a first shift register including a plurality of driving transistors, the first shift register being configured to provide a first driving signal to a first driving node and to provide a second driving signal to a second driving node by turning on or turning off the plurality of driving transistors based on a first scan start signal or a previous scan output signal, and a plurality of driving clock signals;

a second shift register including a plurality of masking transistors, the second shift register being configured to provide a masking signal to a masking output node by turning on or turning off the plurality of masking transistors based on a second scan start signal or a previous masking output signal, and a plurality of masking clock signals; and a buffer circuit including a plurality of buffer transistors, the buffer circuit being configured to provide the scan signals by turning on or turning off the plurality of buffer transistors based on a plurality of scan clock signals that include a first pulse and a second pulse, the first driving signal, the second driving signal, and the masking signal.

9. The display device of claim 8, wherein the buffer circuit outputs the scan signals that include the first pulse or the scan signals that include the first pulse and the second pulse based on the masking signal.

10. The display device of claim 8, wherein the buffer transistors are p-channel metal-oxide semiconductor (PMOS) transistors.

11. The display device of claim 10, wherein the buffer circuit outputs the scan signals that include the first pulse when the masking signal has a low level.

12. The display device of claim 10, wherein the buffer circuit outputs the scan signals that include the first pulse and the second pulse when the masking signal has a high level.

13. The display device of claim 8, wherein the buffer transistors are n-channel metal-oxide semiconductor (NMOS) transistors.

14. The display device of claim 13, wherein the buffer circuit outputs the scan signals that include the first pulse when the masking signal has a high level.

15. The display device of claim 13, wherein the buffer circuit outputs the scan signals that include the first pulse and the second pulse when the masking signal has a low level.

16. The display device of claim 8, wherein the timing controller receives an input data of the plurality of pixel circuits and divides a frame into a plurality of periods.

17. The display device of claim 16, wherein the scan driver outputs the scan signal that includes the first pulse in a partial period among the plurality of periods.

18. The display device of claim 16, wherein the scan driver outputs the scan signal that includes the first pulse and the second pulse in a partial period among the plurality of periods.

19. The display device of claim 8, wherein each of the scan driving blocks provides the scan signal to at least one scan line.

* * * * *